US005992541A

United States Patent [19]

Frenzel et al.

[11] Patent Number: 5,992,541

[45] Date of Patent: Nov. 30, 1999

[54] DRILLING AND/OR CHISELLING TOOL

[75] Inventors: Jens Frenzel, Fürstenfeldbruck; Helmut Nussrainer, Isen; Hans-Werner Bongers-Ambrosius, München, all of Germany

[73] Assignee: Hilti Aktiengesellschaft, Schaan, Liechtenstein

[21] Appl. No.: 09/056,585

[22] Filed: Apr. 7, 1998

[30] Foreign Application Priority Data

Apr. 7, 1997 [DE] Germany ..... 197 14 287

[51] Int. Cl.[6] ..... B25D 11/04

[52] U.S. Cl. ..... 173/201; 173/48; 173/109

[58] Field of Search ..... 173/104, 109, 173/200, 201, 128, 48, 210, 212

[56] References Cited

U.S. PATENT DOCUMENTS

| | | | |
|---|---|---|---|
| 4,442,906 | 4/1984 | Simpson | 173/48 |
| 4,567,951 | 2/1986 | Fehrle et al. | 173/201 |
| 4,657,088 | 4/1987 | Grossman et al. | 173/109 |
| 5,111,890 | 5/1992 | Ranger et al. | 173/104 |
| 5,435,397 | 7/1995 | Demuth | 173/201 |
| 5,775,440 | 7/1998 | Shinma | 173/201 |

*Primary Examiner*—Scott A. Smith
*Attorney, Agent, or Firm*—Brown & Wood, LLP

[57] ABSTRACT

A tool for drilling and/or chiselling has an axially extending guide tube (9) with at least one radially extending air passage (10) and a control body for selectively closing the air passage. The control body has the stop (30) interacting with a first stop shoulder (18) on a driving anvil (17). The control body can be displaced relative to the guide tube (9) opposite to the working direction of the tool against the biasing action of a spring (12) supported on a connecting sleeve (13) of the control body. The driving anvil (17) has a second stop shoulder (19) facing opposite to the working direction and interacting with a stop surface (20) facing in the working direction. The stop surface (20) is secured axially with the guide tube (9).

12 Claims, 3 Drawing Sheets

DRILLING AND/OR CHISELLING TOOL

BACKGROUND OF THE INVENTION

The present invention is directed to a drilling and/or chiseling tool including a housing with an axially extending guide tube projecting out of the housing in a working direction of the tool. A striking mechanism is mounted in the guide tube and includes a first piston reciprocating in the guide tube with a free second piston located ahead of the first piston toward a leading end of the guide tube with the two pistons arranged to form an air cushion between them. A driving anvil is located within the guide tube ahead of the second piston and arranged to be driven by the second piston as the first piston is reciprocated and the second piston is correspondingly reciprocated via the air cushion. The guide tube has at least one air passage extending radially therethrough located in the range between the first and second pistons. A control body displaceable in the working direction is arranged to selectively close the air passage. The control body includes a first stop for contacting a first stop shoulder on the driving anvil and the first stop is displaceable opposite to the working direction against the biasing action of a spring.

German patent 26 41 070 discloses a drilling and/or chiseling tool with a guide tube, a piston in a striking mechanism and a second piston arranged axially movable in the guide tube. Between the two pistons, the guide tube has a radially extending air passage which can be closed by a control body and the control body can be displaced axially relative to the guide tube.

When the air passage is open, the interior of the guide tube is ventilated whereby pressure cannot be developed by the piston of the striking mechanism which is necessary for the axial displacement of the other piston in the working direction. When the air passage is closed by the control body, a pressure can be developed within the guide tube between the two pistons. A stop on the control body, formed as a base, interacts with a first stop shoulder of a driving anvil arranged co-axially in the guide tube so that it can be driven axially.

Before a receiving material is worked by the tool and before the tool is started, a drilling or chiseling bit inserted in the tool chuck is pressed against the receiving material with great force. At the same time, the drilling or chiseling tool, as well as the driving anvil, is guided and the control body interacting with the driving anvil is shifted relative to the tool housing opposite to the working direction so that the control body, after closing the air passages, is located against a stop edge of the tool housing facing in the working direction.

When the tool is lifted from the receiving material after a working operation has been completed, the air passage should be released or opened as quickly as possible so that the striking mechanism piston no longer develops a pressure and cannot reciprocate the other piston, the driving anvil, and the drilling or chiseling bit in the working direction. A rapid release of the air passage is obtained due to the fact that the control body is displaced as rapidly as possible in the working direction into its starting position.

Since the total contacting force is transferred by the control body to the housing, the control body must be constructed very solidly and have a very high strength and, accordingly, a high weight. Rapid shifting of such a solidly formed control body in the working direction is effected by a strong spring, also of a heavy construction, supported at the housing of the tool counter to the working direction and interacting with the control body. The high weight of the spring and control body have a negative effect on the total weight of the tool. Due to its high total weight, the tool is difficult to anvil and the operator tires rapidly.

SUMMARY OF THE INVENTION

Therefore, the primary object of the present invention is to provide a drilling and/or chiseling tool having a low total weight which can be easily anvil, manufactured economically and operated safely.

In accordance with the present invention, a drilling and/or chiseling tool is provided in which the driving anvil is provided with a second stop shoulder spaced in a working direction from a first stop shoulder and facing opposite to the working direction. The second stop shoulder is arranged to contact a stop surface connected to the guide tube and facing in the working direction and the spacing between the first and second stop shoulders is greater than the spacing between the stop and the stop surface.

The limitation of the axial displacement of the driving anvil opposite to the working direction is achieved by the second stop shoulder on the driving anvil and by the stop surface connected axially with the guide tube. The contacting pressure, necessary for working the receiving material, is transferred from the drilling or chiseling bit to the driving end and from the driving anvil via the guide tube to the housing of the drilling and/or chiseling tool. The control body, interacting with the first stop shoulder of the driving anvil, has a low strength and a low weight. The individual parts of the control body are formed with very thin walls and have a low mass. Since the control body of the invention has a very low weight, it can be displaced with very little force parallel to the working direction. The spring, used for displacing the control body in the working direction when the tool is lifted from the receiving material, has a low spring force and a low weight. Because the spring and the individual parts of the control body have a low weight, a tool with a low weight can be created.

For manufacturing reasons, preferably the second stop shoulder projects radially outwardly from the first stop shoulder. To keep the total weight of the tool as low as possible, and for maintaining the least possible number of individual parts, the stop surface, interacting with the second stop shoulder, preferably is formed as a part of or is connected directly to the guide tube.

For supporting the driving anvil over its entire periphery with respect to the housing, the second stop shoulder and the stop surface are advantageously formed as ring-shaped surfaces.

For centering the driving anvil in the guide system of the housing, the ring-shaped surface of the second stop shoulder is preferably formed conically and tapering inwardly counter to the working direction and the corresponding circular surface of the stop surface is formed conically and extending or tapering outwardly in the working direction.

For installation reasons, preferably the control body is formed of a shift fork, a sliding shifter member, and a connecting sleeve, with the stop on the control body, interacting with the first stop shoulder, formed by the shift fork. The weight of the control body is kept very small in an advantageous manner by forming the shift fork and the sliding shifter member as a single piece. The sliding shifter member is guided parallel to the working direction in at least one-slot like opening in the guide tube which extends parallel to the working direction with the shift fork projecting inwardly into the guide tube. The thickness of at least the sliding shifter member, measured perpendicularly to the working direction, corresponds essentially to the thickness of the wall of the guide tube.

For manufacturing reasons, the sliding shifter member and the connecting sleeve are preferably formed as a single piece. To keep the weight forces of the control body very small and, with that, a very rapid reciprocating motion of the control body, the control body is formed at least in part of a plastics material.

To maintain the weight of the drilling and/or chiseling tube very low, preferably the control body is formed at least in part of aluminum.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
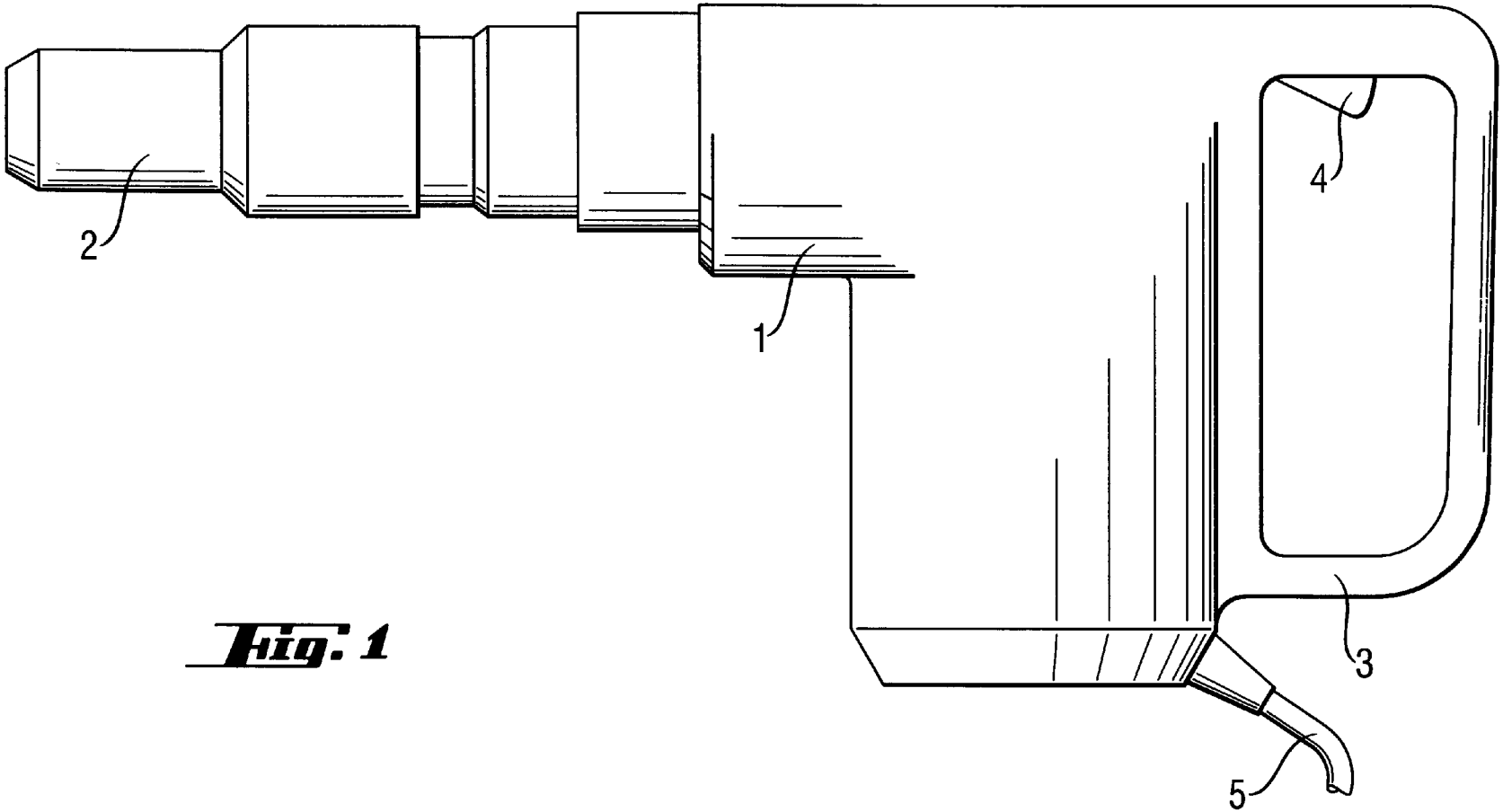
FIG. 1 is a diagrammatic side elevational view of a drilling and/or chiseling tool embodying the present invention but without a bit.
Figure 2:
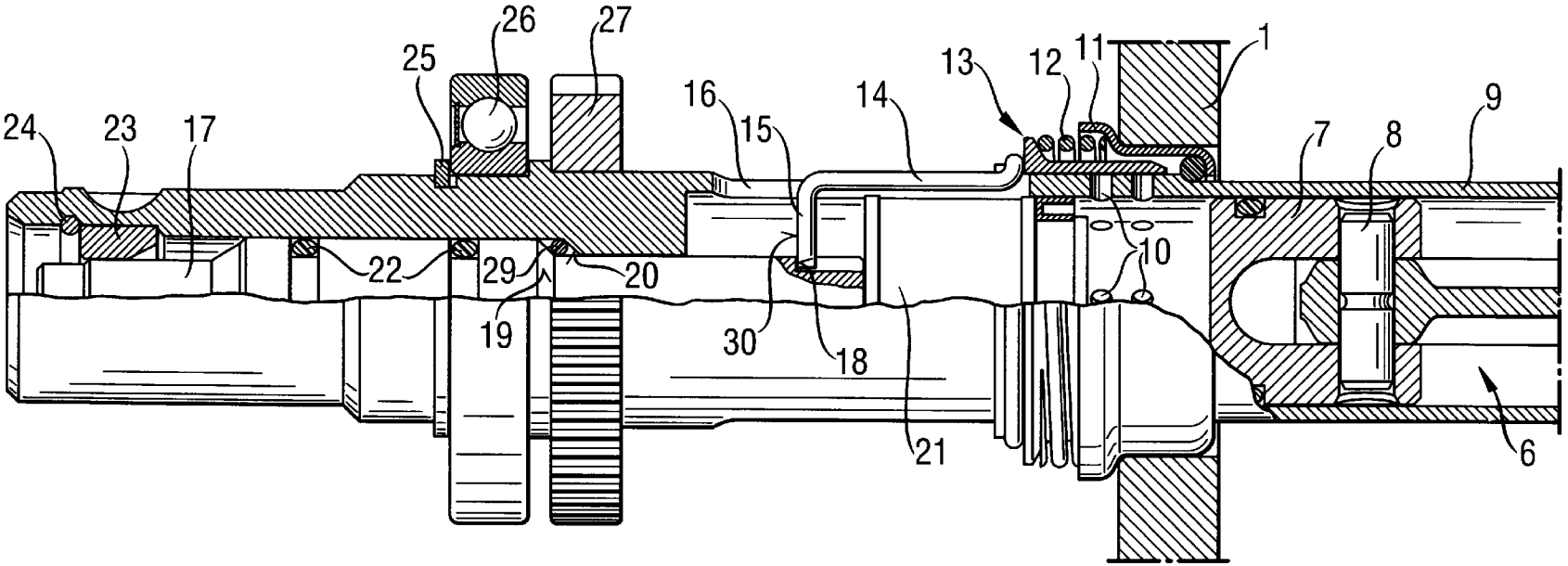
FIG. 2 is a side view partly in section of a guide tube for the tool illustrated in FIG. 1.
Figure 3:
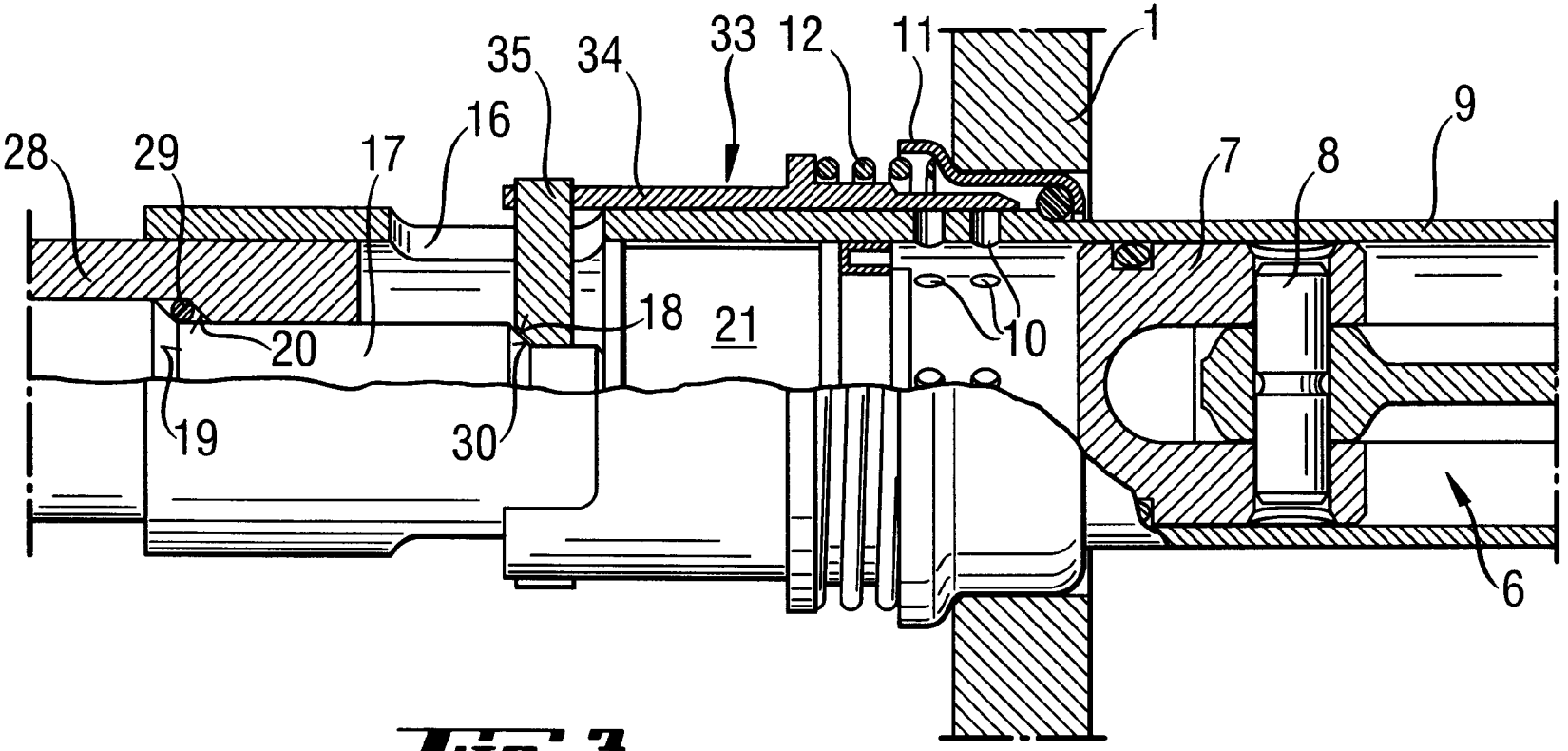
FIG. 3 is a partial side view, partly in section, of the guide tube of another drilling and/or chiseling tool embodying the present invention.

Since the same components are used in the different embodiments, the same reference numerals are used for the embodiments in FIGS. 1–3.

The drilling and/or chiseling tool, shown diagrammatically in FIG. 1, includes a housing 1 with a anvil 3 at the right hand end, an operating switch 4 in the anvil, a tool chuck 2, located at the opposite or left hand end of the housing, for receiving a tool bit, not shown, and an electric cable 5 at the right hand for connecting the tool to an external power source.

Within the drilling and/or chiseling tool, according to FIGS. 2 and 3, there is a guide tube 9 extending parallel to the working direction. The working direction is towards the left as viewed in FIG. 1. The guide tube 9 has a leading end projecting outwardly from the housing 1, note FIGS. 2 and 3, and a trailing end located to the right within the housing. A striking mechanism 6 shown only in part, is located within the guide tube and includes a first piston 7. The striking mechanism reciprocates the first piston 7 within the guide tube. In the striking mechanism 6, bolt 8 extending transversely of the working direction or the axial direction connects the first piston 7 to a piston rod extending toward the trailing end of the guide tube.

Ahead of the first piston 7 towards the leading end of the guide tube, there is a free second piston 21 arranged to be reciprocated by an air cushion developed when the first piston 7 is reciprocated by the striking mechanism 6. The air cushion is located between the first and second piston 7, 21 In the range of the guide tube 9 between the pistons, several radially extending air passages 10 are provided and the pressure of the air cushion located between them can be generated by the first piston 7. The air passages 10 are controlled by a control body made up of a shift fork 15, 35 a sliding shifter member 14, 34 and a connecting sleeve 13, 33. A stop 30 on the shift fork 15 interacts with a first stop shoulder 18 formed in the trailing end of the driving anvil 17.

As shown in FIGS. 2 and 3, a second stop shoulder 19 on the driving anvil 17, in the position when the tool contacts the receiving material to be worked, bears against a stop surface 20 firmly connected axially with the guide tube 9. A damping element 29 is located between the second stop shoulder 19 and the stop surface 20. When the tool is lifted from the surface of the receiving material, not shown, the driving anvil 17 is displaced in the working direction by the second piston 21. At the same time, the control body is shifted in the working direction by a spring 12 encircling and supported at one end on the connecting sleeve 13, 33 of the control body and at the opposite end by a bushing 11. Bushing 11 is pressed into an accommodating borehole of the housing 1 and is supported counter to the working direction by a radially expanding collar of the circumferential region of the accommodating borehole of the housing 1.

In the control body illustrated in FIG. 2, the connecting sleeve 13 is formed as a sleeve and extends around a axially extending portion of the outside surface of the guide tube 9 in the region of the air passages 10. The shift fork 15, which interacts with the driving anvil 17, and the sliding shifter member 14 are formed as a one piece component positively connected to the connecting sleeve 13. The one-piece component is constructed as a wire hoop. A trailing end of the wire hoop, formed as a ring, projects into a depression in the connecting sleeve 13. Another part of the wire hoop extends essentially parallel to the axial direction from the ring and the leading end of the wire hoop is bent at a right angle and extends parallel to the plane of the ring. The thickness of the wire corresponds substantially to the thickness of the wall of the guide tube 9 in the region of its opening 16 through which a part of the component projects into the interior of the guide tube 9. The wire hoop shaped component is formed from steel and the connecting sleeve 13 from steel, plastics material or aluminum.

As can be noted from FIG. 2, the driving anvil 17, located between the second piston and the leading end of the guide tube 9, can be displaced in the working direction to a limited extent because of a damping ring 23 positioned in the guide tube 9. Opposite to the working direction, the damping ring 23 is supported at a shoulder on the inside of the guide tube 9, the shoulder faces in the working direction and at its leading end the damping ring bears against a securing ring 24 in a groove in the inside surface of the guide tube 9. In its outside surface the driving anvil 17 has two circumferentially extending depressions each containing an O-shaped sealing ring 22.

On the outside surface of the guide tube 9 there is a part of a total bearing of the guide tube 9, in the form of a ball bearing 26 supported opposite the working direction against an outer shoulder of the guide tube 9 and, in the working direction, it is supported at a circumferentially extending securing ring 25 firmly secured in the axial direction of the guide tube 9. In the direction opposite to the working direction, adjacent the outer shoulder of the guide tube 9, there is a gear wheel 27 pressed onto the guide tube 9 which interacts with a driving mechanism, not shown, and insures that the guide tube 9 carries out a rotational movement while the receiving material is being worked and sets in rotation a tool bit secured in the tool chuck 2.

In FIG. 3 a control body, different from that illustrated in FIG. 2, is shown and is formed by a connecting sleeve 33 and a sliding shifting member 34 which parts are formed as a one piece components positively connected with a shift fork 35. The shift fork 35 has a plate shape with a central through hole serving to accommodate a projection extending opposite to the working direction from the first stop shoulder 18 of the driving anvil 17. At the central through hole of the shift fork 35 there is a stop 30 in contact with the first stop shoulder 18. The one-piece component is in the form of a sleeve and, in the region of the shift fork 35, as two diametrically opposite openings engaged positively by the two radially outer ends of the shift fork 35. The surface 20, interacting with the second stop shoulder 19 of the driving anvil 17, is formed by a driving anvil guide 28 firmly secured in the axial direction with the guide tube 9, for example, by a pressed connection.

The shift fork 35 and the one-piece component are formed, for example, from steel, plastics material and aluminum.

If the tool is in an idle position not pressed against the receiving material, not shown, the driving anvil 17 bears against the damping ring 23 and the spring 12 presses the control body in the working direction uncovering the air passages 10. An axial displacement of the driving anvil 17 is not possible, since with the air passages uncovered, pressure cannot be built up within the guide tube 9 between the first and second pistons 7, 21.

While specific embodiments of the invention have been shown and described in detail to illustrate the inventive principles, it will be understood that the invention may be embodied otherwise without departing from such principles.

What is claimed is:

1. A tool for at least one of drilling and chiselling comprises a housing (1), an axially extending guide tube (9) mounted in said housing with the axis thereof extending parallel to a working direction of said tool, said guide tube (9) having a leading end spaced outwardly from said housing and a trailing end with said ends spaced apart in the working direction, said working direction acting in the direction from the trailing end towards the leading end of said guide tube (9), a striking mechanism (6) mounted in said guide tube (9) toward the trailing end thereof, said striking mechanism (6) includes a first piston (7) guided in said guide tube for reciprocating movement in the axial direction of said guide tube (9), a second piston (21) located within said guide tube (9) and spaced from said first piston in the axial direction of said guide tube towards the leading end thereof for forming an air cushion in said guide tube (9) between said first and second pistons (7, 21), a driving anvil (17) located within said guide tube (9) on the opposite side of said second piston from said first piston and arranged to be driven by said second piston as said first piston is reciprocated and said second piston is correspondingly reciprocated via said air cushion, said guide tube (9) having at least one air passage extending radially therethrough in a axially extending region between said first and second pistons (7, 21), a control body displaceable in the working direction relative to said guide tube for selectively closing said air passage, said control body comprises a first stop (30) for contacting a first stop shoulder (18) on said driving anvil (17) with said first stop shoulder facing opposite to the working direction, said first stop (30) being displaceable opposite to the working direction against a biasing action of a spring (12), said driving anvil (17) has a second stop shoulder (19) spaced in the working direction from said first stop shoulder (18) and facing opposite the working direction, said second stop shoulder (19) arranged to contact a stop surface (20) connected to said guide tube (9) and facing in the working direction, and the spacing between said first and second stop shoulders (18, 19) being greater than the spacing between said stop (30) and said stop surface (20).

2. A tool, as set forth in claim 1, wherein said second stop shoulder (19) projects radially outwardly beyond said first stop shoulder (18).

3. A tool, set forth in claim 1 or 2, wherein said stop surface (20), interacting with said second stop shoulder (19) is formed as a part of said guide tube (9).

4. A tool, as set forth in claim 1 or 2, wherein said second stop shoulder (19) and said stop surface (20) are ring-shaped surfaces.

5. A tool, set forth in claim 4, wherein the ring-shaped surface of said second stop shoulder (19) tapers conically inwardly opposite to the working direction and the ring-shaped surface of said stop surface (20) expands conically outwardly in the working direction.

6. A tool as set forth in claim 1 or 2, wherein said control body is formed of a shift fork (15, 35), an axially extending sliding shifter member (14, 34) and a connecting sleeve (13, 33), said stop (30) of said control body interacting with said first stop shoulder (18) and formed by said shift fork (15, 35).

7. A tool, set forth in claim 6, wherein said shift fork (15) and said shifter member (14) are formed as one piece.

8. A tool, as set forth in claim 6, wherein said shifter member (34) and said connecting sleeve (33) are formed as one piece.

9. A tool, as set forth in claim 6, wherein said control body is formed at least in part of a plastics material.

10. A tool, as set forth in claim 7, wherein said control body is formed at least in part of a plastics material.

11. A tool, as set forth in claim 8, wherein said control body is formed at least in part of a plastics material.

12. A tool, as set forth in claim 9, wherein said control body is formed at least in part of aluminum.

* * * * *